US012111141B2

(12) United States Patent
Stubbs et al.

(10) Patent No.: US 12,111,141 B2
(45) Date of Patent: Oct. 8, 2024

(54) AMMUNITION BELT LINK

(71) Applicant: BAE SYSTEMS plc, London (GB)

(72) Inventors: Joshua Matthew Stubbs, Crewe (GB); Nathan William Rowe, Crewe (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 18/005,413

(22) PCT Filed: Jul. 9, 2021

(86) PCT No.: PCT/GB2021/051759
§ 371 (c)(1),
(2) Date: Jan. 13, 2023

(87) PCT Pub. No.: WO2022/013530
PCT Pub. Date: Jan. 20, 2022

(65) Prior Publication Data

US 2023/0258441 A1 Aug. 17, 2023

(30) Foreign Application Priority Data

Jul. 16, 2020 (EP) ..... 20275118
Jul. 16, 2020 (GB) ..... 2010963.3

(51) Int. Cl.
*F42B 39/08* (2006.01)

(52) U.S. Cl.
CPC ..... *F42B 39/087* (2013.01); *F42B 39/08* (2013.01)

(58) Field of Classification Search
CPC ..... F42B 39/08; F42B 39/087
See application file for complete search history.

(56) References Cited

U.S. PATENT DOCUMENTS 891,374 A * 6/1908 Ruszitszka ..... F42B 39/08 59/8
1,376,354 A * 4/1921 Peoples ..... F42B 39/08 89/35.01
2,022,685 A * 12/1935 Moore ..... F42B 39/08 59/8

(Continued)

FOREIGN PATENT DOCUMENTS

FR 755845 A 11/1933
GB 0141129 A 4/1920

(Continued)

OTHER PUBLICATIONS

International Search Report and Written Opinion received for PCT/GB2021/051757. Mailed: Oct. 1, 2021. 12 pages.

(Continued)

*Primary Examiner* — Gabriel J. Klein
(74) *Attorney, Agent, or Firm* — Finch & Maloney PLLC

(57) ABSTRACT

According to the present invention, there is provided an ammunition belt link comprising, a sprung wire, said sprung wire arranged to form a first receiving portion suitable for retaining a first ammunition cartridge, a second receiving portion suitable for retaining a second ammunition cartridge, a spacer between said first receiving and second receiving portions, an ammunition cartridge locator aide, said locator aid locates in an ejector groove of a received cartridge and, the wire ammunition belt link further comprising a support surface suitable for retaining the first and/or second ammunition cartridge.

18 Claims, 6 Drawing Sheets

(56) References Cited

U.S. PATENT DOCUMENTS

| | | | | |
|---|---|---|---|---|
| 2,163,725 | A * | 6/1939 | Bergmann | F42B 39/08 89/35.01 |
| 2,426,527 | A | 6/1944 | Sanford et al. | |
| 2,376,962 | A * | 5/1945 | French | F42B 39/08 89/35.01 |
| 2,453,540 | A * | 11/1948 | Reid | F42B 39/08 59/900 |
| 2,472,817 | A * | 6/1949 | Gaidos | F42B 39/08 89/35.02 |
| 2,856,819 | A | 10/1958 | Meyers et al. | |
| 3,650,176 | A * | 3/1972 | Lindner | F42B 39/08 89/35.02 |
| 2012/0144712 | A1 | 6/2012 | Rostocil | |
| 2014/0069290 | A1* | 3/2014 | Padgett | F42B 5/313 102/466 |
| 2016/0202032 | A1* | 7/2016 | Kokinis | F42B 39/08 89/35.02 |
| 2023/0266108 | A1 | 8/2023 | Stubbs et al. | |

FOREIGN PATENT DOCUMENTS

| | | | |
|---|---|---|---|
| GB | 813627 | | 5/1959 |
| GB | 892831 | A | 3/1962 |
| WO | 2022013528 | A1 | 1/2022 |
| WO | WO 2022013530 | A1 | 1/2022 |

OTHER PUBLICATIONS

GB Search Report under Section 17(5) received for GB Application No. 2010964.1, dated Oct. 22, 2020. 3 pages.

Extended European Search Report received for EP Application No. 20275119.4, dated Jan. 12, 2021. 6 pages.

International Search Report and Written Opinion received for PCT/GB2021/051759. Mailed: Oct. 8, 2021. 10 pages.

GB Search Report under Section 17(5) received for GB Application No. 2010963.3, dated Oct. 14, 2020. 3 pages.

Extended European Search Report received for EP Application No. 20275118.6, dated Jan. 12, 2021. 7 pages.

* cited by examiner

AMMUNITION BELT LINK

The present invention relates generally to a lightweight wire ammunition belt link and a related method of manufacture of said link.

Ammunition belt links are used to hold ammunition cartridges for belt fed weapon systems in order to allow continuous rapid firing of said weapon systems without the need to reload a magazine. The first belt links were typically made of canvas strips however these were prone to contamination by water and oils which contract the fabric and prevent rounds being extracted by the bolt mechanism of the firearms.

Modern day belt links are disintegrating links which are typically pressed from a flat sheet of metal to form a double circular channel designed to retain two cartridges. The individual belt links are able to 'hook' on the next cartridge, said cartridge retained by another link in order to form a continuous chain of ammunition at the desired length of the user. As the cartridge is extracted and expended from the link by the bolt mechanism of the weapon system, the individual link separates from the chain and is ejected from the feed mechanism. Non-disintegrating metallic feed strips can also be used to hold ammunition cartridges however these are limited by round capacity and can generally hold only 24-30 rounds per strip.

It will be appreciated by the skilled person that such belt links add weight to an ammunition system which may have consequences, for example, airborne systems in terms of range and endurance or indeed man portable weapons where ammunition weight makes up a substantial proportion of a soldier's carrying weight. It will be therefore be further appreciated that any reduction in weight of said ammunition systems is beneficial.

It is an example aim of the present invention to at least partially solve or avoid one or more problems or disadvantages with disintegrating plate belt links, whether identified herein or elsewhere, namely that of reducing weight in ammunition belt links.

According to a first aspect of the present invention there is provided, a wire ammunition belt link comprising, a sprung wire, said sprung wire arranged to form, a first receiving portion suitable for retaining a first ammunition cartridge, a second receiving portion suitable for retaining a second ammunition cartridge, and a spacer between said first receiving and second receiving portions, an ammunition cartridge locator aide, said locator aid locates in an ejector groove of a received cartridge; and the wire ammunition belt link further comprising a support surface suitable for retaining the first or second ammunition cartridge; the support surface extending away from said first receiving and/or second receiving portions.

The use of the support surface in combination with the wire ammunition belt link may enhance the rigidity and robustness of said belt link. Further, the support surface may enable greater contact area with the retained ammunition cartridges whilst being up to 60% lighter than conventional ammunition belt links as is known in the art. For example, a traditional disintegrating plate belt link for a 7.62 mm cartridge weighs 4 g whereas a wire ammunition belt link made from 1.25 mm mild steel sprung wire weighs 1.379 g.

The support surface may be located within the first and/or second receiving portion formed by the sprung wire.

The support surface may be made from any suitable material, such as, for example a polymer, elastomer, rubber, metal, metal alloys, fabric or polymer composites.

The polymers may be selected from any suitable polymer, such as, for example, polyesters, polyimides, polyamides, polyurethanes, polyethylene, polypropylenes, acrylics, PVC, polystyrenes, nylons, perfluoropolymers, such as Teflon etc. Preferably, the support surface is made from a polymer. The use of a fibre reinforced composite, may provide structural rigidity to the support surface, such as, for example a glass or carbon fibre filled binder.

The sprung wire may be integrally embedded within the support surface such that it is wholly or partially enveloped by the support surface material. In such arrangement, the sprung wire acts as a skeleton within the support surface.

The sprung wire may act as a frame around the edge of the support surface. It will be appreciated that in such an arrangement, the sprung wire may be fully encapsulated or partially exposed (ie. not fully embedded within the support surface).

In a further arrangement, the sprung wire and support surface may be reversibly joined. The reversible connection may be achieved by way of a mechanical fastening or interference fit, such reversible connection may allow the separation of the support surface from the sprung wire after use which may aide in recycling of the wire ammunition belt link.

The sprung wire may be bonded to the support surface, the bond may be achieved by an adhesive, such as, for example an epoxy, which provides a rigid permanent connection between the sprung wire and support surface.

In a preferable arrangement, the sprung wire is integrally embedded within the support surface, as part of the manufacture of said support surface.

The length of the support surface may be substantially the same length of the body of the received ammunition cartridge. For 7.62 mm calibre ammunition, the support surface may be in the range of from 5 mm to 27 mm, preferably, the length is in the range of from 12 mm to 27 mm.

The support surface may be of any suitable thickness for use with a belt fed ammunition system. For example, the support surface thickness may be in the range of from 0.25 mm-2 mm however it will be appreciated that a support surface thickness must not be large enough to foul the ammunition feeding system and thus it is preferable that the support surface is the same thickness or less than the diameter of the sprung wire.

The support surface may be a rigid body or it may be flexible body depending on the type of material and construction used. For example, the support surface may be a rigid body plastic part or alternatively may be a flexible fabric mesh. Alternatively, the support surface may be a mix of both rigid and flexible body regions. In a preferable arrangement, the support surface is a rigid body. The support surface may comprise a surface coating. The surface coating may be a layer of a further material applied to the support surface. The surface coating may be a high-friction coating which may aide in retaining the ammunition cartridge. The coefficient of friction value may be selected by the skilled person to ensure that the ammunition cartridge can still be ejected by the weapon system into the chamber. The further materials may be those identified as support surface materials hereinbefore defined.

The surface coating may be a protective coating to prevent environmental contamination, and may provide protection of the sprung wire.

The support surface may comprise friction-enhancing geometries such as ridges, splines and other similar projections to better retain the received ammunition cartridges.

The support surface may have cross section shape with any geometry, particularly those which allow the first and/or second ammunition cartridge to be retained more securely. The cross section shape may be circular or polygonal, such as square, pentagonal, hexagonal, octagonal or indeed any higher sided shape or any combination thereof that allows the ammunition cartridge to be retained. It will however be appreciated in a shape other than circular, the faces of the shape must contact with the ammunition cartridge in order for it to be retained by friction. In a highly preferable arrangement, the support surface is circular in nature to provide the greatest contact area with the ammunition cartridge case.

The support surface may retain the first and second ammunition cartridges, respectively, by way of a 'push fit' interference engagement such that there is interference between the cartridge and support surface of the belt link.

In a preferred arrangement, the ammunition may be a 'push fit' interference engagement with, and/or the support surface. The minimum cross sectional distance of the support surface may be in the range of from 1% to 6% smaller than the diameter of the received ammunition cartridge, preferably the minimum cross sectional distance is in the range of from 4% to 5% smaller than the received ammunition cartridge.

The ammunition cartridges are manufactured to tight tolerances, typically to a standard, such as for example NATO standard. This allows a 5.56×45 mm or 7.62×51 mm cartridge to be fired from all NATO nominated weapon platforms. Both the projectile and cartridge case dimensions, diameter, length are readily available. Further, the force required by the ejection mechanism on the weapon, to eject the ammunition cartridge from the link is known, and must be great than the frictional force provided by the sprung wire and/or sprung wire with the support surface.

The cross sectional distance of the support surface may change along the direction of the axial length of the received ammunition cartridge. This change in diameter may allow engagement with a second wire ammunition belt link over the support surface to enable joining as a continuous belt link and prevent lateral movement of the second wire ammunition belt link along the length of the ammunition cartridge with respect to the first wire ammunition belt link. It will be appreciated that any such change in diameter must not interfere with stripping of the ammunition cartridge from the link during normal firearm function.

In one arrangement, the support surface may be located in only the first receiving portion, and the second receiving portion is a sprung wire.

The inner cross sectional distance of the second receiving portion, in other words, the maximum internal cross sectional distance between the opposite faces on the sprung wire where an ammunition cartridge may be received, may be greater than that of maximum outer cross sectional distance of the first receiving portion and support surface in order to allow the second receiving portion to 'hook' onto the outer face of the support surface of a first receiving portion of a second wire ammunition belt link i.e. when joined in a continuous link. The same applies to a wire link where the support surface is located in a second receiving portion, the first receiving portion may have a greater cross sectional distance.

Preferably the sprung wire links are disintegrating links.

The wire ammunition belt link may be of a 'push through' cartridge feed design. In this design configuration, a received cartridge is pushed forwards through the ammunition belt link into the barrel of the weapon by a bolt. In such designs, it is necessary that the first and second receiving portions comprise an opening, a non-closed loop, such as, for example a re-entrant or half-open portion, in order to allow the bolt mechanism of the weapon system to function correctly. E.g. the sprung wire extends around the ammunition cartridge at a value less than 360°. In a 'push through' design, it is expressly not permissible to allow the sprung wire to extend around the complete circumference of the received ammunition cartridge as such designs will foul the feed mechanism of the weapon system.

The first and second receiving portions may be provided by a plurality of wire arms with the support surface extending therefrom. The first and second receiving portions may comprise a first arm and a second arm. The first arm may comprise a first partial receiving portion for the first ammunition cartridge and a second partial receiving portion for the second ammunition cartridge. The second arm may comprise a first partial receiving portion for the first ammunition cartridge and a second partial receiving portion for the second ammunition cartridge.

In one arrangement the first receiving portion comprises:

- the first arm comprising a first partial receiving portion for the first cartridge,
  - a second arm comprising a first partial receiving portion for a first cartridge,
- and the second receiving portions comprises:
  - a first arm comprising a second partial receiving portion for a second cartridge,
  - a second arm, comprising a second partial receiving portion for the second cartridge,
- wherein there is a first partial support surface for the first cartridge and/or a second partial support surface for the second cartridge, wherein the first arm and second arm are joined by a linkage and the respective first and second partial receiving portions are joined by a spacer.

The support surface may extend outwardly from the first arm and/or the second arm. Preferably, the support surface extends to provide a support surface between the first partial receiving portion and the second partial receiving portion.

According to a second aspect, there is provided a method of manufacturing a wire ammunition belt link, the method comprising, I) bending a continuous length of sprung wire by a wire forming machine to create a wire ammunition belt link and, II) forming a support surface on said wire ammunition belt link.

Step I of the method may comprise bending a continuous length of sprung wire by a wire forming machine to create the wire ammunition belt link. Such machines are well known in the art and may include manual wire forming machines or CNC wire forming machines.

In an alternative manufacturing method, the sprung wire may be manufactured by bonding or fusing a plurality of pre-sprung wire formed sections to create the wire ammunition belt link. In another alternative method, the sprung wire may be forged in a near final shape before being rolled to the required final shape.

The method may comprise manufacturing a plurality of wire ammunition belt links from a continuous length of sprung wire before being cut to form individual wire ammunition belt links. For example, a sprue of 5, 10, 15 or 20 links to support mass production techniques.

The method may further comprise coating the sprung wire with a protective layer. Said layer may be deposited by a number of known techniques such as wire extrusion, electrodeposition and painting.

In a highly preferable method, the wire ammunition belt link is formed by a wire forming machine from a continuous length of sprung wire to form at least two arms, spacer and linkage.

Step II of the method may comprise placing the wire ammunition belt link within an injection mould and injecting a polymer to form around the sprung wire such that it is partially or wholly enveloped by the polymer to form a support surface.

Alternative methods of manufacturing a support surface may include but are not limited to for example forging, additive layer manufacture, extrusion moulding, thermoforming and blow moulding.

Alternatively, the support surface may be manufactured separately from the sprung wire and joined at a later stage of manufacture by way of a bonding process or reversible connection such as a push fit connection, such connection enabled by the geometry of the support surface. For example, pre formed ridges which enable the sprung wire to click into place.

Alternatively, where the support surface is a fabric, the fabric support surface may be joined to the sprung wire by way of adhesive or stitching. Such process may be achieved by way of a machine or manual fitment.

In a highly preferable method, the wire ammunition belt link may be formed by a wire forming machine from a continuous length of sprung wire to form a plurality of wire ammunition belt links such that they form a sprue, each wire ammunition belt link comprising at least two arms, spacer and linkage. Said sprue is placed within an injection mould whereupon a polymer is injected to form a support surface on each wire ammunition belt link such that the sprung wire forms a skeleton structure or frame integrally embedded within the support surface. At the end of this process, the sprue is cut to form individual wire ammunition belt links.

There may be provided a wire ammunition belt link comprising, a sprung wire, said sprung wire arranged to form, a first receiving portion suitable for retaining a first ammunition cartridge, a second receiving portion suitable for retaining a second ammunition cartridge and, a spacer between said first receiving and second receiving portions.

The sprung wire of the ammunition belt link may be made of metal, metal alloys, polymers or composites. In a preferred arrangement, a material with a material hardness in the range of from 390-470HV and Youngs Modulus in the range of 1000 to 1500 MPa, preferably 1112 MPa may be used, thereby providing materials which may return to their original shape when subject to large deflections or twisting. Preferably, the sprung wire of the wire ammunition belt link is made from metal. The metals may be selected from steels, shape memory alloys, titanium. More preferably, the sprung wire is made from sprung mild steel, such as, for example carbon steel DIN 1544-C45N DIN 17200.

The sprung wire may be of any suitable cross section shape, highly preferably the sprung wire is circular. The sprung wire may be of any suitable diameter (gauge), which allows proper engagement with a feed mechanism of a weapon system so as to avoid fouling the feed mechanism or weapon chamber. The selection of the diameter of the sprung wire may be determined with reference to the manufacturer's guidelines of the relevant weapon system to which the ammunition belt link is to be used. It was found for a 7.62 mm system, preferably the diameter of the sprung wire is in the range from 0.25–2 mm, more preferably in the range from 0.5-0.8 mm. It would be clear that the diameter will be selected depending on the weapons system used, the same as for disintegrating plate belt link.

In a further arrangement, the sprung wire, may be reduced in diameter at selected points, to reduce the dimension of the sprung wire.

The sprung wire may be coated by a protective layer or the support surface; such as to prevent oxidisation or to increase friction. Protective layers may be selected from any commonly used materials to protect metals, such as, for example, polymers, phosphates, paints, lacquers, metal plating.

The sprung wire may be made of a plurality of individual wire pieces joined together to form the individual ammunition belt link or may be made from a unitary piece of sprung wire. In a highly preferred arrangement, the ammunition belt link contains only a unitary piece of sprung wire formed into said belt link; the unitary piece of sprung wire is a continuous length of sprung wire.

The first and second receiving portion may retain the first and second ammunition cartridges, respectively, by way of a 'push fit' interference engagement such that there is interference between the cartridge and the first and second receiving portions of the belt link.

In a preferred arrangement the first and second receiving portions may be a 'push fit' interference engagement and the minimum cross sectional distance of the first and second receiving portions may be in the range of from 1% to 6% smaller than the diameter of the received ammunition cartridge.

Preferably the minimum cross sectional distance is in the range of from 4% to 5% smaller than the received ammunition cartridge. The ammunition cartridges are manufactured to tight tolerances typically to a standard, such as for example NATO standard. This allows any calibre, i.e. 5.56 mm, intermediate, 7.62 mm or even higher calibre bullets to be fired from multiple weapon platforms.

The projectile and cartridge case dimensions, diameter, length are readily available. Further, the force required by the ejection mechanism on the weapon, to eject the ammunition cartridge from the link is known.

The first and second receiving portions and support surfaces may extend at least 180 degrees around the circumference of the ammunition cartridge; more preferably, the receiving portions may be re-entrant in shape, greater than 180 degrees, in order for the ammunition cartridge to be suitably retained. The first and second receiving portions and support surfaces may extend around the ammunition cartridge in the range from 180 to 320 degrees; preferably extend in the range from 296 to 280 degrees around the ammunition cartridge.

The spacer between the first and second receiving portions provides the required separation between the two ammunition cartridges. Particularly, the spacer provides a separation gap between the centre points of the first ammunition cartridge and second ammunition cartridge, when fitted within the ammunition belt link. The separation gap ensures that the ammunition can engage with a belt fed ammunition system. If the separation gap between the centre points of the first and second ammunition cartridge are too close together or are too far apart, the weapon feed system will not function correctly. The separation gap provided by the spacer is known and is defined according to the manufacturer's guidelines of the relevant weapon system.

The spacer may be made of the same or of a different material from that of the first and second retaining portions. The spacer may be formed by the support surface. For example, the spacer may be a polymer clip or a sprung wire. The sprung wire may be different piece of sprung wire to that of the first and second receiving portions sprung wire, however in a highly preferable arrangement, the spacer, the first and second retaining portions i.e. entire belt link may be formed from a unitary piece of wire.

The spacer may take the form of different geometries, so as to provide different separation gaps. For example when a made from a sprung wire, the spacer may be a simple re-entrant bend. Alternatively the spacer may be a loop or coil of wire rotating about at least 360 degrees. The thickness of the spacer, will be selected to provide the required separation gap between the ammunition within the belt link.

The sprung wire may comprise a flange, said flange may be positioned length ways along the axial length of the ammunition cartridge. The flange may extend outwardly from the first and/or second receiving portions, to provide increased grip with the ammunition cartridge, by increase the contact area of the belt link, and improve retention of the ammunition. In a preferable arrangement, there are two flanges formed from the sprung wire. In a further preferable arrangement, the flanges, first and second receiving portions and respective spacers are made from a unitary piece of wire. The flanges may also comprise a flange support surface extending therefrom.

The wire ammunition belt link comprise an ammunition cartridge locator aide, said cartridge locator aid at a first end extends from the belt link, and the second distil end in use locates in the ejector groove of a received ammunition cartridge. The locator aid may comprise a locator aid support surface extending therefrom.

The locator aid may have a length selected to cause the wire ammunition belt link to be accurately and repeatedly located on the ammunition cartridge such that when joined in a link, the cartridges are all in alignment. Said locator aide may cause the ammunition cartridges, when fitted within the wire ammunition belt link, to be correctly orientated in the same direction. Said locator aide further ensures that the ammunition belt link and subsequent adjacent wire belt links are in the correct position in order to be ejected from a weapon system. The locator aide may be formed from a unitary piece of wire. In a preferable arrangement, the ammunition cartridge locator aide may be and extension from one of the flanges.

There may be provided an offset between the first and second receiving portions such that the difference in offset allows the second receiving portion to 'hook' onto the next ammunition cartridge in between or outside of the first receiving portion of a second wire ammunition belt link when linked as a belt. The difference in offsets may be in the range of 1 to 5 mm. preferably, the difference in offset is in the range of 1 to 2 mm although it will be appreciated that the difference in offset must be at least the cross sectional diameter of the sprung wire to avoid overlapping with an adjacent link. It will further be appreciated that the maximum offset is limited by the length of the ammunition cartridge body and/or the weapon feed mechanism Said 'hooking' action of the second receiving portion is enough to retain the second ammunition cartridge whilst allowing rotational movement about the axis of the ammunition cartridge in order to allow the first wire ammunition belt link to rotate with respect to the second wire ammunition belt link.

The arrangement of multiple belt links as defined herein, may have offsets selected such that the first receiving portions on one link, abuts the second receiving portion.

The wire ammunition belt link may have further receiving portions, for example, a third receiving portion, a fourth receiving portion etc. but this may reduce flexibility of the ammunition when linked together, as there is reduced articulation of the wire ammunition belt link as a whole.

The first and second receiving portion may be provided by a plurality of wire arms. Said first and second receiving portions may comprise a first arm and a second arm. The first arm may comprise a first partial receiving portion for the first ammunition cartridge and a second partial receiving portion for the second ammunition cartridge. The second arm may comprise a first partial receiving portion for the first ammunition cartridge and a second partial receiving portion for the second ammunition cartridge.

The first and second wire arms of the ammunition belt link may be made of metal, metal alloys, polymers or composites. In a preferred arrangement, the first and second wire arms are made from a sprung wire as herein described before, more preferably, the sprung wire is made from sprung mild steel.

The first and second wire arms may be joined by a linkage. The linkage may be made of the same or of a different material to that of the first and second wire arm. The linkage may comprise a linkage support surface extending therefrom. For example, the linkage may be a plastic clip or a sprung wire. In a highly preferable arrangement, there is one linkage joining the first and second wire arms made from the same sprung wire as the first and second wire arm such that they are formed from a unitary piece of wire.

In another arrangement, there may be a plurality of linkages joining the first and second arms of the first and second receiving portions distributed along the length of the first and second arms for enhanced rigidity.

The first and second partial receiving portions of the first and second wire arms may be joined by a spacer as described herein before. In a preferable arrangement, the spacer is made from a re-entrant loop or coil of wire. In a further preferable arrangement, the spacer is made from the same piece of unitary wire as that of the first and second arm such that it is a unitary length of wire.

The first and second wire arms of the first and second receiving portions may be offset from each other axially along the cartridge. The axial offset ensures the angular alignment of adjacent ammunition cartridges with respect to each other, such that they are parallel. The minimum axial offset between the first arm and second arm of the first and second receiving portions may be in the range of from 10 to 27 mm. Preferably, the offset is in the range of from 12 to 14 mm.

The offset between the partial sections of the first arm and second wire arm that together form the first receiving portion may be greater than or smaller than the offset between the partial sections of the first wire arm and second wire arm that together form the second receiving portion. The difference in offset allows the partial sections of the first and second arms that form the second receiving portion to 'hook' on to the next ammunition cartridge in between or outside of the partial sections of the first and second arms that together form the first receiving portion of a second wire ammunition belt link when linked as a belt.

The difference in offsets may be in the range of 1 to 5 mm. preferably, the difference in offset is 1 to 2 mm although it will be appreciated that the difference in offset must be greater than the 2× the cross sectional diameter, i.e. each arm must of the sprung wire must offset greater than the diameter of the sprung wire in order to avoid a clash with an adjacent link. It will further be appreciated that the maximum offset is limited by the length of the ammunition cartridge body and/or the weapon feed mechanism. Said 'hooking' action of the second receiving portion is enough to retain the second ammunition cartridge whilst allowing rotational movement about the axis of the ammunition cartridge in order to allow the first wire ammunition belt link to rotate with respect to the second wire ammunition belt link.

There may be provided further wire arms, such as, for example a third arm, fourth arm, and fifth arm etc. It will be appreciated that subsequent wire arms will in turn form subsequent partial receiving portions, for example, a third, fourth and fifth receiving portion respectively.

According to a third aspect of the present invention there is provided a wire ammunition belt suitable for a belt fed ammunition system, the wire ammunition belt comprising, a first wire ammunition belt link and a second wire ammunition belt link, as defined herein before, wherein a first ammunition cartridge is located in the first receiving portion and a second ammunition cartridge is located in the second receiving portion, and the second ammunition cartridge is further located in a first receiving portion of the second wire ammunition belt link to create the wire ammunition belt; the second ammunition cartridge further retained by the support surface of the first wire ammunition belt link.

The co-location of the second ammunition cartridge within both the second receiving portion of the first wire ammunition belt link and the first receiving portion of the second wire ammunition belt link allows the second wire ammunition belt link to rotate with respect to the first wire ammunition belt link about the second ammunition cartridge. In a preferred arrangement the second receiving portion comprises the locator aid extending therefrom, said locator aid preventing axial movement along the cartridge case, and highly preferably the end of the locator aid prevents rotation of the second receiving portion about said case. Preferably, rotation about the first receiving portion is permitted.

Several arrangements of the invention will now be described by way of example and with reference to the accompanying drawings of which; —

Figure 3A:
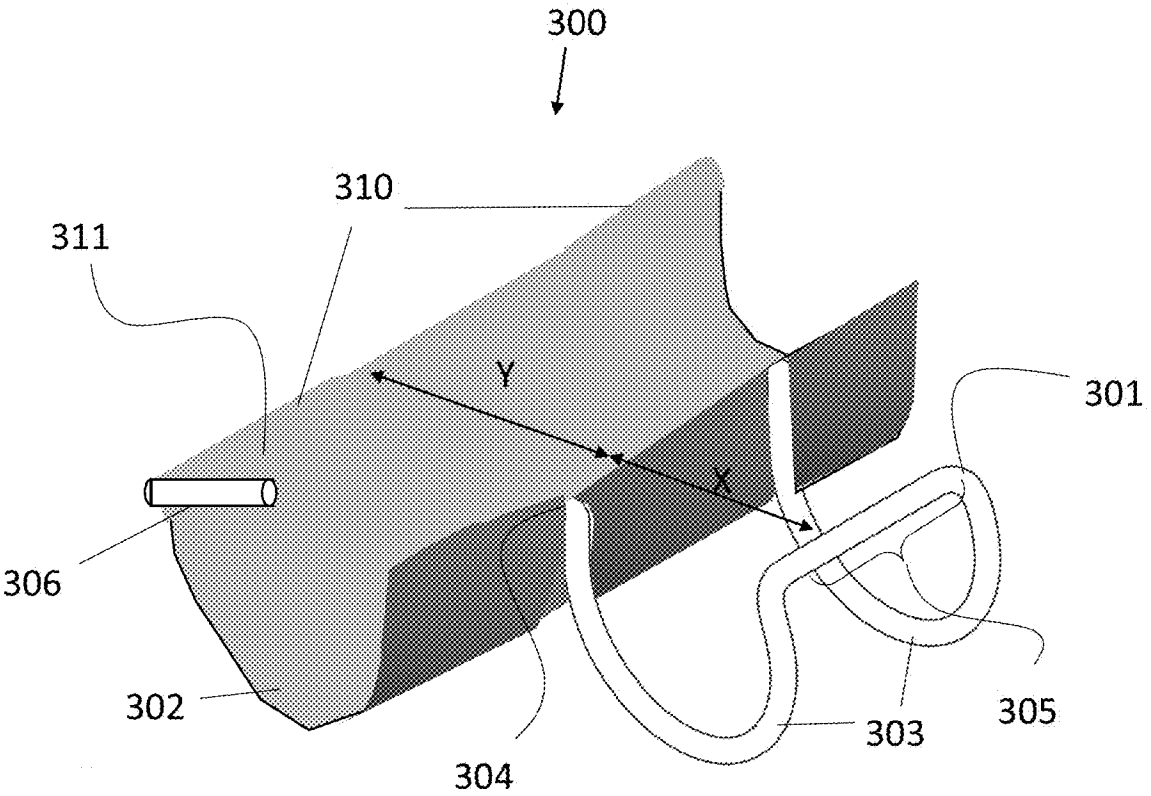

FIG. 3*a* shows an alternative wire ammunition belt link.

Figure 3B:
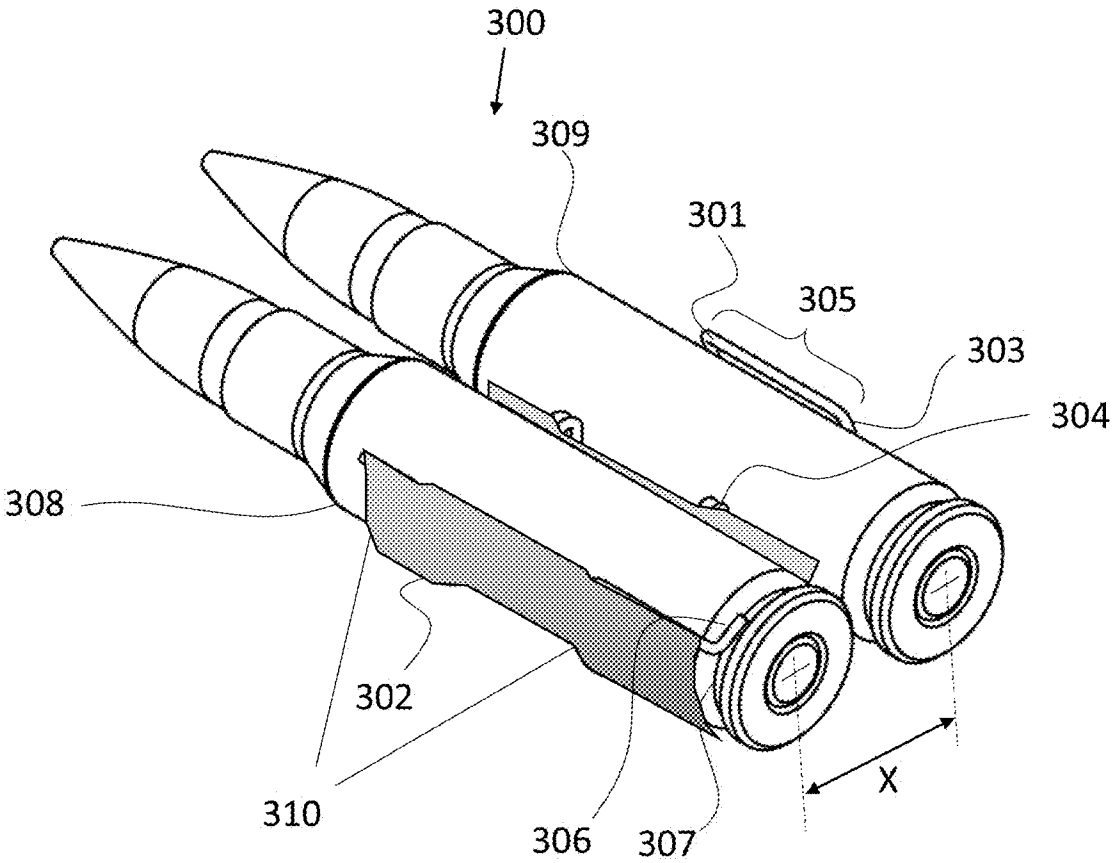

FIG. 3*b* shows the wire ammunition belt link of FIG. 3*a* with ammunition cartridges loaded therein.

Figure 1:
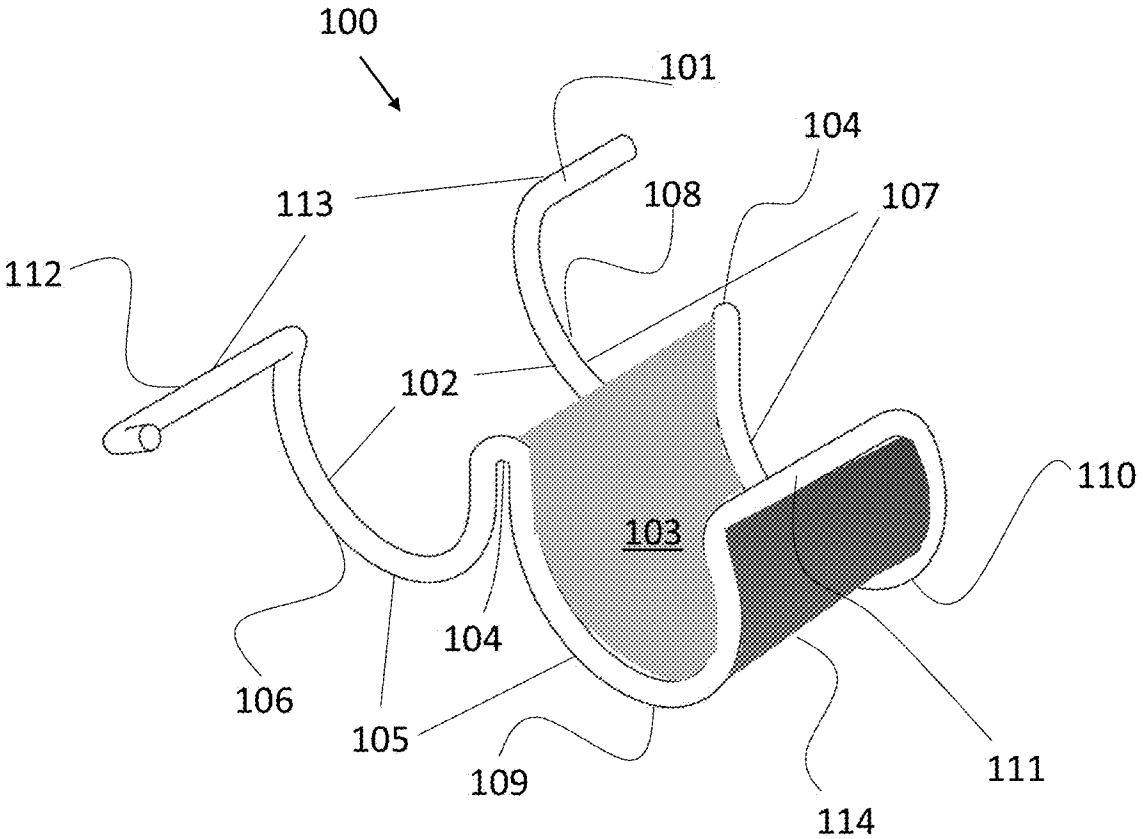
FIG. 1 show a wire ammunition belt link.
Figure 4A:
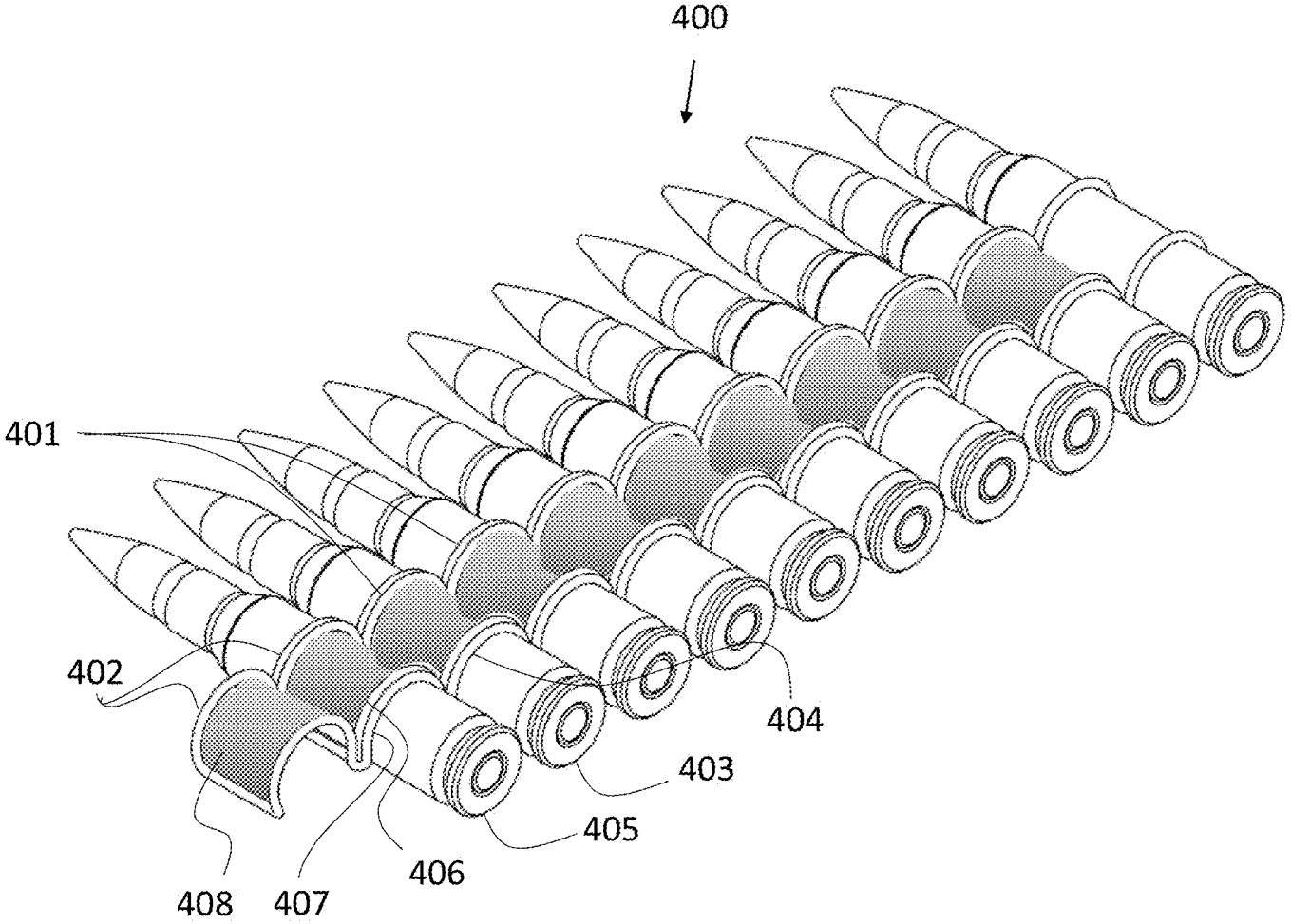
Figure 4B:
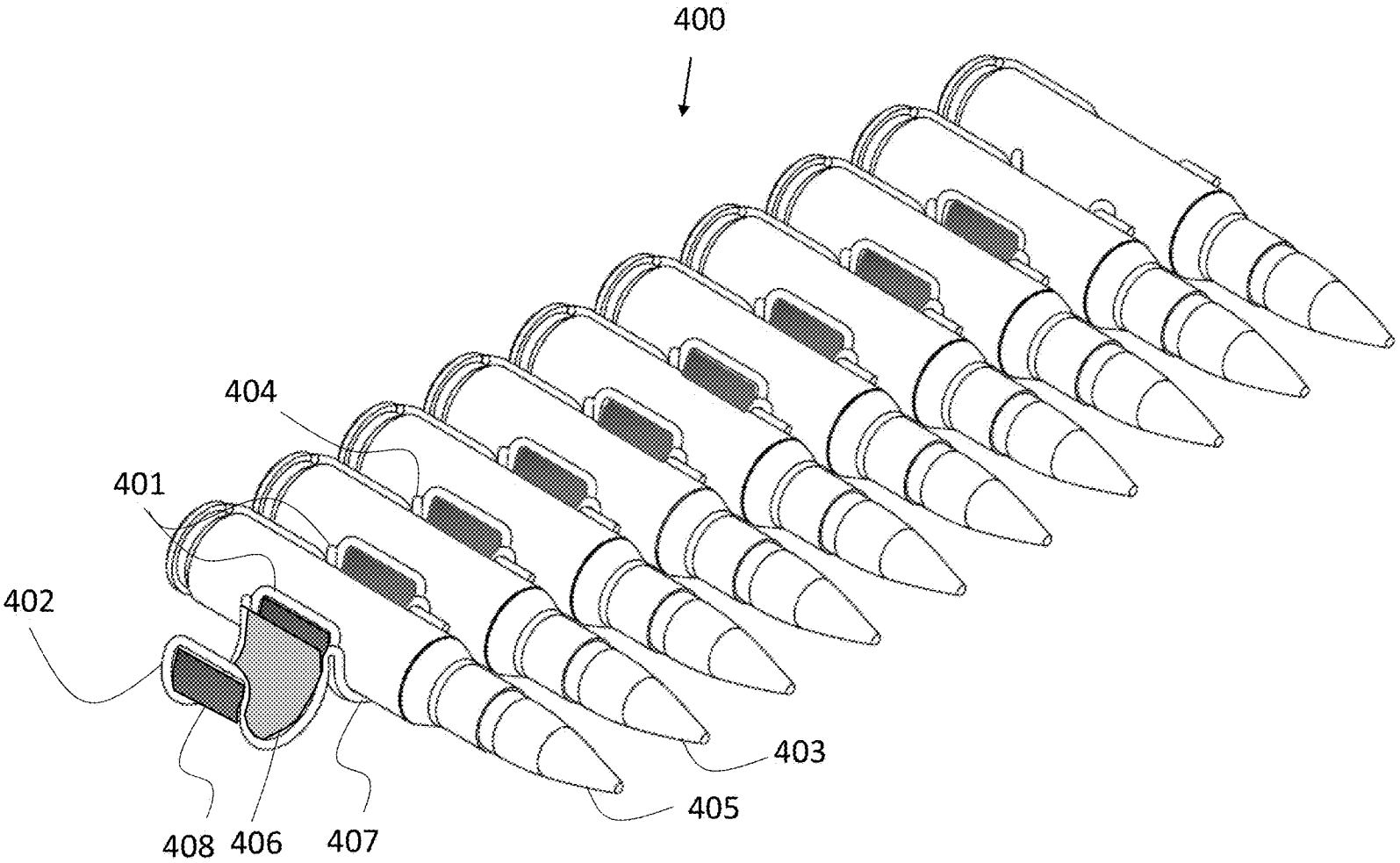

FIG. 4*a* & 4*b* show a wire ammunition belt with wire ammunition belt links of FIG. 1 loaded with ammunition cartridges.

Turning to FIG. 1, there is provided a wire ammunition belt link 100 comprising, a sprung wire 101, said sprung wire arranged to form, a first receiving portion 102 suitable for retaining a first ammunition cartridge (not shown), a second receiving portion 103 suitable for retaining a second ammunition cartridge (not shown) and, a spacer 104 between said first receiving and second receiving portions and the wire ammunition belt link further comprising a support surface 114, extending across the second receiving portion 103, for retaining the second ammunition cartridge.

In the present arrangement, the support surface 114 is made from glass filled nylon and is located within the second receiving portion to retain the second ammunition cartridge, wherein the sprung wire acts as a frame around the edge of the support surface such that the sprung wire is partially visible around the outer edges of the support surface.

In the present arrangement, the cross sectional shape of the support surface is circular in nature to provide the greatest contact area with the ammunition cartridge case.

In the present arrangement, the sprung wire 101 is made from a unitary i.e. continuous piece, of sprung wire formed into said belt link. The sprung wire is made from 1 mm diameter mild steel.

The first and second receiving portions (102, 103) retain the first and second ammunition cartridge by way of a 'push fit' engagement such that there is interference between the ammunition cartridge and the belt link. In the present arrangement, the first and second receiving portions (102, 103) are circular in nature with a re-entrant curvature around the ammunition cartridge.

In the present arrangement, the first receiving portion 102 comprises, a first arm 105, said first arm comprising a first partial receiving portion 106 for the first ammunition cartridge and a second arm 107 comprising a first partial receiving portion 108 for the first ammunition cartridge.

The second receiving 103 portion comprises, the first arm 105, said first arm comprising a second partial receiving portion 109 for the second ammunition cartridge and a second arm 107 comprising a second partial receiving portion 110 for the second ammunition cartridge.

The first arm and second arm of the first and second receiving portions are joined by a linkage 111 at the ends of the first and second arms such that it is a continuous unitary sprung wire, said linkage made of the same material of the first and second arm.

The provision of a spacer 104 allows separation between the centre points of the first ammunition cartridge and second ammunition cartridge, when fitted within the ammunition belt link, to allow engagement with a belt fed ammunition system. In the present arrangement, the spacer 104 is formed from the same unitary piece of wire as that of the first retaining portion 102, second retaining portion 103 and the link 111. The spacer 104 may be any shape, in this arrangement a single re-entrant bend/loop which provides spacing between the centre points of the neighbouring ammunition cartridge when loaded into the wire ammunition belt link.

In the present arrangement, there is provided two flanges 113. Said flanges are positioned length ways along the axial length of the ammunition cartridge located at the distil ends of the first and second arms. In the present embodiment, one of the flanges is an ammunition cartridge locator aide 112, said aid locates in the ejector groove of a received ammunition cartridge to enable the wire ammunition belt link to be accurately located axially along the ammunition cartridge such that when joined in a belt i.e. when joined as a plurality of belt links, the cartridges align at their headstamps.

Two ammunition cartridges may be linked by just one arm 105, with first receiving portions and second receiving portions containing only the first partial receiving portion 106 for the first ammunition cartridge and the second receiving portion containing only the second partial receiving portion 109 for the second ammunition cartridge. However the use of two or more arms provides rigidity and improves retention of the ammunition cartridge in the receiving portion.

Figure 2:
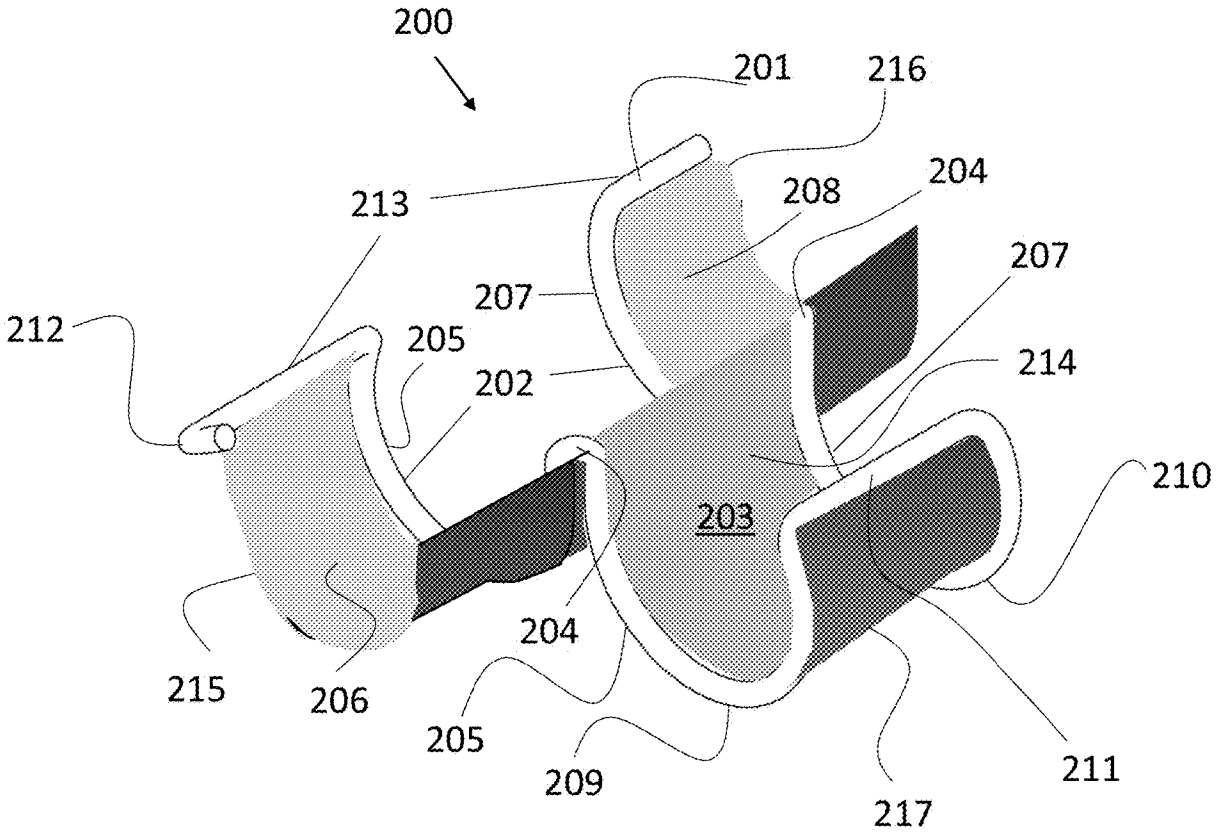
FIG. 2 shows an alternative wire ammunition belt link.

FIG. 2 shows an alternative arrangement of a wire ammunition belt link wherein there is provided a wire ammunition belt link 200 comprising, a sprung wire 201, said sprung wire arranged to form, a first receiving portion 202 suitable for retaining a first ammunition cartridge (not shown), a second receiving portion 203 suitable for retaining a second ammunition cartridge (not shown) and, a spacer 204 between said first receiving and second receiving portions and the wire ammunition belt link further comprising a support surface 214 suitable for retaining the second ammunition cartridge.

In the present arrangement, the sprung wire 201 is made from a unitary i.e. continuous piece, of sprung wire formed into said belt link. The sprung wire is made from 1 mm diameter mild steel.

The first and second receiving portions (202, 203) retain the first and second ammunition cartridge by way of a 'push fit' engagement such that there is interference between the ammunition cartridge and the belt link. In the present arrangement, the first and second receiving portions (202, 203) are circular in nature with a re-entrant curvature around the ammunition cartridge.

In the present arrangement, the first receiving portion 202 comprises, a first arm 205, said first arm comprising a first partial receiving portion 206 for the first ammunition cartridge and a second arm 207 comprising a first partial receiving portion 208 for the first ammunition cartridge.

The second receiving 203 portion comprises, the first arm 205, said first arm comprising a second partial receiving portion 209 for the second ammunition cartridge and a second arm 207, comprising a second partial receiving portion 210 for the second ammunition cartridge.

The first arm and second arm of the first and second receiving portions are joined by a linkage 211 at the ends of the first and second arms such that it is a continuous unitary sprung wire, said linkage made of the same material of the first and second arm.

The provision of a spacer 204 allows separation between the centre points of the first ammunition cartridge and second ammunition cartridge, when fitted within the ammunition belt link, to allow engagement with a belt fed ammunition system. In the present arrangement, the spacer 204 is formed from the same unitary piece of wire as that of the first retaining portion 202, second retaining portion 203 and the link 211. The spacer 204 may be any shape, in this arrangement a single re-entrant bend/loop which provides spacing between the centre points of the neighbouring ammunition cartridge when loaded into the wire ammunition belt link.

In the present arrangement, there is provided two flanges 213. Said flanges are positioned length ways along the axial length of the ammunition cartridge located at the distil ends of the first and second arms. In the present embodiment, one of the flanges is an ammunition cartridge locator aide 212, said aid locates in the ejector groove of a received ammunition cartridge to enable the wire ammunition belt link to be accurately located axially along the ammunition cartridge such that when joined in a belt i.e. when joined as a plurality of belt links, the cartridges align at their headstamps.

Two ammunition cartridges may be linked by just one arm 205, with first receiving portions and second receiving portions containing only the first partial receiving portion 206 for the first ammunition cartridge and the second receiving portion containing only the second partial receiving portion 209 for the second ammunition cartridge. However the use of two or more arms provides rigidity and improves retention of the ammunition cartridge in the receiving portion.

In the present arrangement, there is further provided a first partial support surface 215 located at the first partial receiving portion of the first arm for retaining a first ammunition cartridge and a second partial support surface 216 located at the first partial receiving portion of the second arm for retaining the same first ammunition cartridge and a further, separate, support surface 217 located at the second receiving portion for retaining a second ammunition cartridge disposed between the first and second arms.

The first and second partial support surface at the first receiving portion and the support surface at the second receiving portion is a unitary piece of plastic wherein the sprung wire is integrally embedded within the support surface such that the sprung wire is wholly enveloped within the support surface material.

In a present arrangement, the cross sectional shape of the support surface is circular in nature to provide the greatest contact area with the ammunition cartridge case.

Turning to FIG. 3*a* there is provided an alternative arrangement of a wire ammunition belt link 300 comprising, a sprung wire 301, said sprung wire arranged to form, a first receiving portion 302 suitable for retaining a first ammunition cartridge (not shown), a second receiving portion 303 suitable for retaining a second ammunition cartridge (not shown) and, a spacer 304 between said first receiving and second receiving portions and the wire ammunition belt link further comprising a support surface 311 suitable for retaining the second ammunition cartridge.

In the present arrangement, the sprung wire 301 is made from a unitary i.e. continuous piece, of sprung wire formed into said belt link. The sprung wire is made from 1 mm diameter mild steel.

The first and second receiving portions (302, 303) retain the first and second ammunition cartridge by way of a 'push fit' engagement such that there is interference between the ammunition cartridge and the belt link. In the present arrangement, the first and second receiving portions (302, 303) are circular in nature with a re-entrant curvature around the ammunition cartridge.

In the present arrangement, there is provided two flanges 310. Said flanges are positioned length ways along the axial length of the ammunition cartridge. In the present embodiment, one of the flanges is an ammunition cartridge locator aide 306, said aid locates in the ejector groove 307 (See FIG. 3*b*) of a received first ammunition cartridge 308 to enable the wire ammunition belt link to be accurately located axially along the ammunition cartridge such that when joined in a link, the cartridges align.

In the present arrangement, the support surface (311) is made from plastic wherein the sprung wire is integrally embedded within the support surface in the first receiving portion such that it acts as a skeleton structure to give rigidity to the wire ammunition belt link.

In the present arrangement, the cross sectional distance X of the second receiving portion is greater than cross sectional distance Y of the first receiving portion in order to allow the second receiving portion to 'hook' on the outer surface of the first receiving portion support surface.

Turning to FIG. 3*b*, there is provided the wire ammunition belt link as shown in FIG. 3*a* with a first ammunition cartridge (308) and second ammunition cartridge (309) loaded therein.

Turning to FIGS. 4*a* & 4*b*, there is provided a wire ammunition belt 400 suitable for a belt fed ammunition system, the wire ammunition belt comprising, a first wire ammunition belt link 401 and a second wire ammunition belt link 402 as shown in FIG. 1, wherein a first ammunition cartridge 403 is located in a first receiving portion 404 and a second ammunition cartridge 405 is located in a second receiving portion 406 of the first wire ammunition belt link, the first or second ammunition cartridge further retained by the support surface 408 of the first wire ammunition belt link, and the second ammunition cartridge is further located in a first receiving portion 407 of the second wire ammunition belt link to create the continuous wire ammunition belt.

Although a few preferred arrangements have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing arrangement(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A wire ammunition belt link comprising:

a unitary continuous piece of sprung wire, said unitary continuous piece of sprung wire arranged to form a first receiving portion suitable for retaining a first ammunition cartridge, a second receiving portion suitable for retaining a second ammunition cartridge, a spacer between said first receiving and second receiving portions, and an ammunition cartridge locator aide, said locator aid locates in an ejector groove of a received cartridge; and a support surface arranged within the first receiving portion or the second receiving portion, wherein the first receiving portion or the second receiving portion comprises a first arm and a second arm spaced from the first arm along a first direction, and wherein the support surface extends an entire distance between the first arm and the second arm along the first direction, wherein the sprung wire forms a frame abutting outer edges of the support surface.

2. The wire ammunition belt link of claim 1, wherein the support surface is made from a polymer, metal or fabric.

3. The wire ammunition belt link of claim 1, wherein the sprung wire is embedded within the support surface.

4. The wire ammunition belt link of claim 1, wherein the sprung wire and support surface are reversibly joined.

5. The wire ammunition belt link of claim 1, wherein the support surface comprises ridges or splines.

6. The wire ammunition belt link of claim 1, wherein the wire ammunition belt link contains only the support surface and the unitary continuous piece of sprung wire formed into said belt link.

7. The wire ammunition belt link of claim 1, wherein the support surface has a cross section of a circular re-entrant shape.

8. The wire ammunition belt link of claim 1, wherein the link is a 'push through' cartridge feed design.

9. The wire ammunition belt link of claim 1, wherein:

each of the first arm and the second arm comprises a first partial receiving portion for the first ammunition cartridge and a second partial receiving portion for the second ammunition cartridge;

the first arm and second arm are joined by a linkage and the respective first and second partial receiving portions are joined by the spacers;

the support surface is a first support surface extending between the first partial receiving surface of the first arm and the first partial receiving surface of the second arm; and the wire ammunition belt link further comprises a second support surface coupled to the second partial receiving surface of the first arm, and a third support surface coupled to the second partial receiving surface of the second arm.

10. The wire ammunition belt link of claim 1, wherein the ammunition cartridge locator aide is provided at the end of a first flange positioned at an end of the first arm of the second receiving portion, the first flange arranged lengthwise along an axis of the retained second ammunition cartridge, and wherein the unitary continuous piece of sprung wire is further arranged to form a second flange at an end of the second arm of the second receiving portion, the second flange arranged lengthwise along the axis of the retained second ammunition cartridge.

11. A wire ammunition belt suitable for a belt fed ammunition system, the wire ammunition belt comprising:

a first wire ammunition belt link and a second wire ammunition belt link according to claim 1;

wherein the first ammunition cartridge is located in the first receiving portion of the first wire ammunition belt link and the second ammunition cartridge is located in the second receiving portion of the first wire ammunition belt link; and wherein the second ammunition cartridge is further located in the first receiving portion of the second wire ammunition belt link.

12. The wire ammunition belt of claim 11, wherein for each of the first and second wire ammunition belt links, the respective support surface extends from the respective first and/or second receiving portion.

13. The wire ammunition belt of claim 11, wherein for each of the first and second wire ammunition belt links, the respective support surface is made from a polymer, metal or fabric.

14. The wire ammunition belt of claim 11, wherein for each of the first and second wire ammunition belt links, the respective sprung wire is embedded within the respective support surface.

15. The wire ammunition belt of claim 11, wherein for each of the first and second wire ammunition belt links, the respective sprung wire and respective support surface are reversibly joined.

16. The wire ammunition belt of claim 11, wherein for each of the first and second wire ammunition belt links, the respective support surface comprises ridges or splines.

17. A method of manufacturing a wire ammunition belt link, the method comprising:

bending a unitary continuous length of sprung wire by a wire forming machine to create first and second receiving portions, a spacer, and an ammunition cartridge locator aide, the first receiving portion having first and second arms spaced in a first direction and suitable for retaining a first ammunition cartridge, the second receiving portion having first and second arms spaced in the first direction and suitable for retaining a second ammunition cartridge, the spacer between said first and second receiving portions, and the ammunition cartridge locator aide configured to locate in an ejector groove of a received cartridge; and forming a support surface that extends an entire distance between the first arm and the second arm along the first direction of said first receiving portion, wherein the sprung wire forms a frame abutting outer edges of the support surface.

18. The method according to claim 17, wherein said wire ammunition belt link is located within an injection mould and the support surface is injection moulded around the sprung wire.

* * * * *